US005265310A

United States Patent [19]

Ichinokawa

[11] Patent Number: 5,265,310

[45] Date of Patent: Nov. 30, 1993

[54] HINGE STRUCTURE FOR COUPLING COVER TO BODY OF IMAGE SCANNER

[75] Inventor: Kazuhiro Ichinokawa, Tokyo, Japan

[73] Assignee: Asahi Kogaku Kogyo Kabushiki Kaisha, Tokyo, Japan

[21] Appl. No.: 603,630

[22] Filed: Oct. 26, 1990

[30] Foreign Application Priority Data

Nov. 2, 1989 [JP] Japan ..... 1-128803

[51] Int. Cl.[5] ..... E05D 7/10

[52] U.S. Cl. ..... 16/266; 16/386

[58] Field of Search ..... 16/265, 266, 267, 386

[56] References Cited

U.S. PATENT DOCUMENTS

| | | | |
|---|---|---|---|
| 2,315,801 | 4/1943 | Lave | 16/267 |
| 2,963,734 | 12/1960 | Huget | 16/266 |
| 3,462,179 | 8/1969 | Hinkle | 16/266 X |
| 4,515,424 | 5/1985 | Sakurai | 16/266 X |
| 4,570,437 | 2/1986 | Moritz | 16/266 X |
| 4,603,452 | 8/1986 | Paciorek . | |

FOREIGN PATENT DOCUMENTS

| | | |
|---|---|---|
| 0071144 | 2/1983 | European Pat. Off. . |
| 0127011 | 12/1984 | European Pat. Off. . |
| 0146651 | 7/1985 | European Pat. Off. . |
| 2750958 | 5/1979 | Fed. Rep. of Germany . |
| 2206782 | 5/1974 | France . |
| 1191290 | 5/1970 | United Kingdom . |
| 1292109 | 10/1972 | United Kingdom . |
| 2007755 | 5/1979 | United Kingdom . |
| 2070679 | 9/1981 | United Kingdom . |
| 2076463 | 12/1981 | United Kingdom . |

*Primary Examiner*—Lowell A. Larson
*Assistant Examiner*—Michael J. McKeon
*Attorney, Agent, or Firm*—Sandler Greenblum & Bernstein

[57] ABSTRACT

A hinge structure couples a cover swingably and separably relative to a body of an image scanner. The hinge structure has a pair of hinge units by which the cover is separably joined to the body. Each of the hinge units comprises a rod mounted on the body and at least one hook mounted on the cover and removably engaging the rod. When the cover is in a closed position, lying over the copy support plate of the body, the hook is prevented from being disengaged from the rod by a stop member. When the cover is in an erected open position, the hook can be moved along the rod into a position where the hook can be disengaged from the rod, thereby separating the cover from the body.

12 Claims, 5 Drawing Sheets

FIG.5 (1)
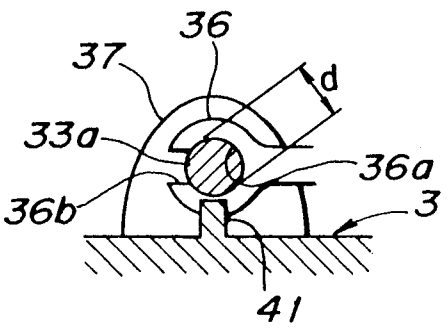
FIG.5 (2)
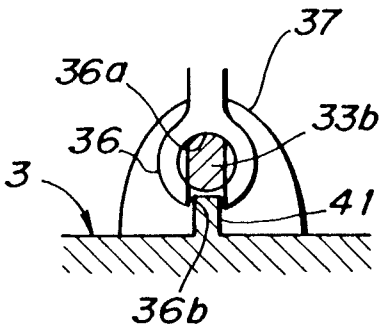
FIG.5 (3)
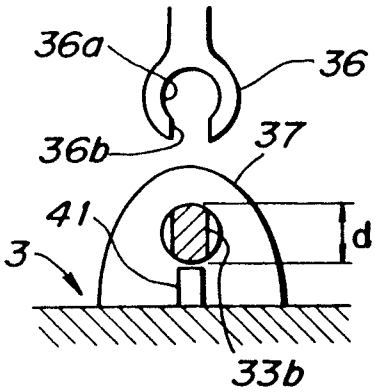

HINGE STRUCTURE FOR COUPLING COVER TO BODY OF IMAGE SCANNER

BACKGROUND OF THE INVENTION

1. Field of the Invention

The present invention relates to a hinge structure for coupling a first member, such as an image scanner cover, relatively swingably and separably to a second member, such as an image scanner body.

2. Description of the Relevant Art

Various image scanners for reading image information from a copy and converting the image information into an electric signal are widely used in many applications such as the entry of image information into a computer. One typical type of image scanner comprises a body having on its upper surface a horizontal copy support plate for placing a copy to be read thereon and a cover, swingably coupled to the body by hinges, for covering the copy support plate. The copy support plate is usually in the form of an elongate rectangular transparent glass panel. The body houses a light source for applying light, from below the copy support plate, to a copy which is placed on the copy support plate with an image side of the copy facing downwardly. An optical system is provided for focusing light reflected from the image side of the copy onto an image focusing surface, and a photoelectric transducer, such as a CCD is positioned in the image focusing surface for generating an electric signal representing the focused image.

The cover serves as a light shield for preventing the light emitted by the light source from reaching the eyes of the user of the image scanner. It also serves as a copy holder for holding the copy, which is often a paper sheet, intimately down against the copy support plate so that the image be used to is well focused on the image focusing surface. In addition, the cover may clamp the copy securely between the cover and the copy support plate to prevent accidental displacement of the copy. In many image scanners the cover is in the form of an elongate plate or board and has a size large enough to cover the entire copy support surface area of the copy support plate. One side of the cover is swingably joined to the body through hinges for angular movement between a closed position (in which the cover lies on the copy support plate, thus covering the copy support surface area), and an open position (in which the side of the cover, opposite to the hinged side, is lifted to allow the user to access the copy on the copy support plate).

The above cover construction is well known in the art, but suffers a problem in relation to the size of the copy. It is often experienced by the user of the image scanner that an image to be read is positioned in only a portion of a large copy, and the entire size of the copy is about the same as or larger than the size of the upper surface of the body of the image scanner. In such a case, the cover interferes with the copy, tending to obstruct the image so that it cannot be positioned desirably in the copy support surface area. To remove such an obstruction, it is desirable that the cover be separated and removed from the body.

The hinges, through which the cover is swingably coupled to the body, may be constructed such that they allow the cover to be separated from the body. The separable hinge structure is more desirable from the standpoint of structural simplicity than other covers which have a structure, other than the hinges, for severing the cover from the body. Desirably or preferably, the separable hinge structure has to meet the following requirements:

1. Members of the hinges which remain on the body after the cover is separated from the body should be small in dimensions, particularly height, in order to facilitate the handling of large-size copies over the copy support surface area of the body.

2. For reliable opening and closing operation of the cover, the cover should not accidentally be separated from the body when the cover is opened and closed by the user while the image scanner is in normal use.

3. For better efficiency, the user of the image scanner himself should easily be able to separate the cover from or couple the cover to the body without assistance of service personnel.

SUMMARY OF THE INVENTION

It is the objective of the present invention to provide a hinge structure which separably couples different members while meeting some or all of the requirements set forth above.

Another objective of the present invention is to provide a hinge structure which is especially suitable for the separable hinged connection of a cover to a body of an image scanner that has a copy support surface area on its upper surface to be covered by the cover.

According to the present invention, there is provided a hinge structure for coupling a first member relatively swingably and separably to a second member. The hinge structure comprises a rod adapted to be fixed to the second member, and an engaging mechanism for disengageably engaging the rod. The engaging mechanism is adapted to be fixed to the first member, and is movable between first and second longitudinal positions in a longitudinal direction of the rod while the engaging mechanism is engaging the rod. This allows the first member to be movable relative to the second member in the longitudinal direction of the rod. The mechanism is also angularly movable about the axis of the rod in at least the first longitudinal position, for thereby allowing the first member to swing relatively to the second member about the axis of the rod. In addition, the engaging mechanism is inseparable from the rod when the engaging mechanism is in the first longitudinal position, and separable from the rod when the engaging mechanism is in the second longitudinal position. The hinge structure also comprises a selective movement limiting mechanism for selectively preventing the engaging mechanism from moving between the first and second longitudinal positions. The selective movement limiting mechanism comprising mean for preventing the engaging means from moving between the first and second longitudinal positions when the engaging mechanism is in a first relative angular position or range with respect to the rod, and for allowing the engaging mechanism to move between the first and second longitudinal positions when the engaging mechanism is in a second relative angular position or range with respect to the rod.

According to the present invention, there is also provided a hinge structure for coupling a first member relatively swingably and separably to a second member. The hinge structure comprises a rod adapted to be fixed to the second member, and a hook on the first member that separably engages the rod and allows the first member to swing with respect to the second member. At least one of the rods and hooks have a disengaging mechanism for disengaging the rod and the hook from each other when the hook is moved on and along the rod in a longitudinal direction thereof. The hinge structure also comprises a ridge adapted to be mounted on the second member, for allowing the hook to move on and along the rod in the longitudinal direction thereof when the first member is inclined a predetermined angle with respect to the second member, and for preventing the hook from moving on and along the rod in the longitudinal direction thereof when the first member is not inclined the predetermined angle with respect to the second member.

The above and other objects, as well as the features and advantages of the present invention, will become more apparent from the following description when taken in conjunction with the accompanying drawings. Preferred embodiments of the present invention are shown by way of illustrative example.

BRIEF DESCRIPTION OF THE DRAWINGS

FIGS. 5(1) through 5(3) are enlarged views of rods, hooks, and stop ridges shown in FIG. 4.

DETAILED DESCRIPTION OF THE PREFERRED EMBODIMENTS

A hinge structure according to a first embodiment of the present invention will first be described below with reference to FIGS. 1, 2, and 3(1) through 3(6).

Figure 1:
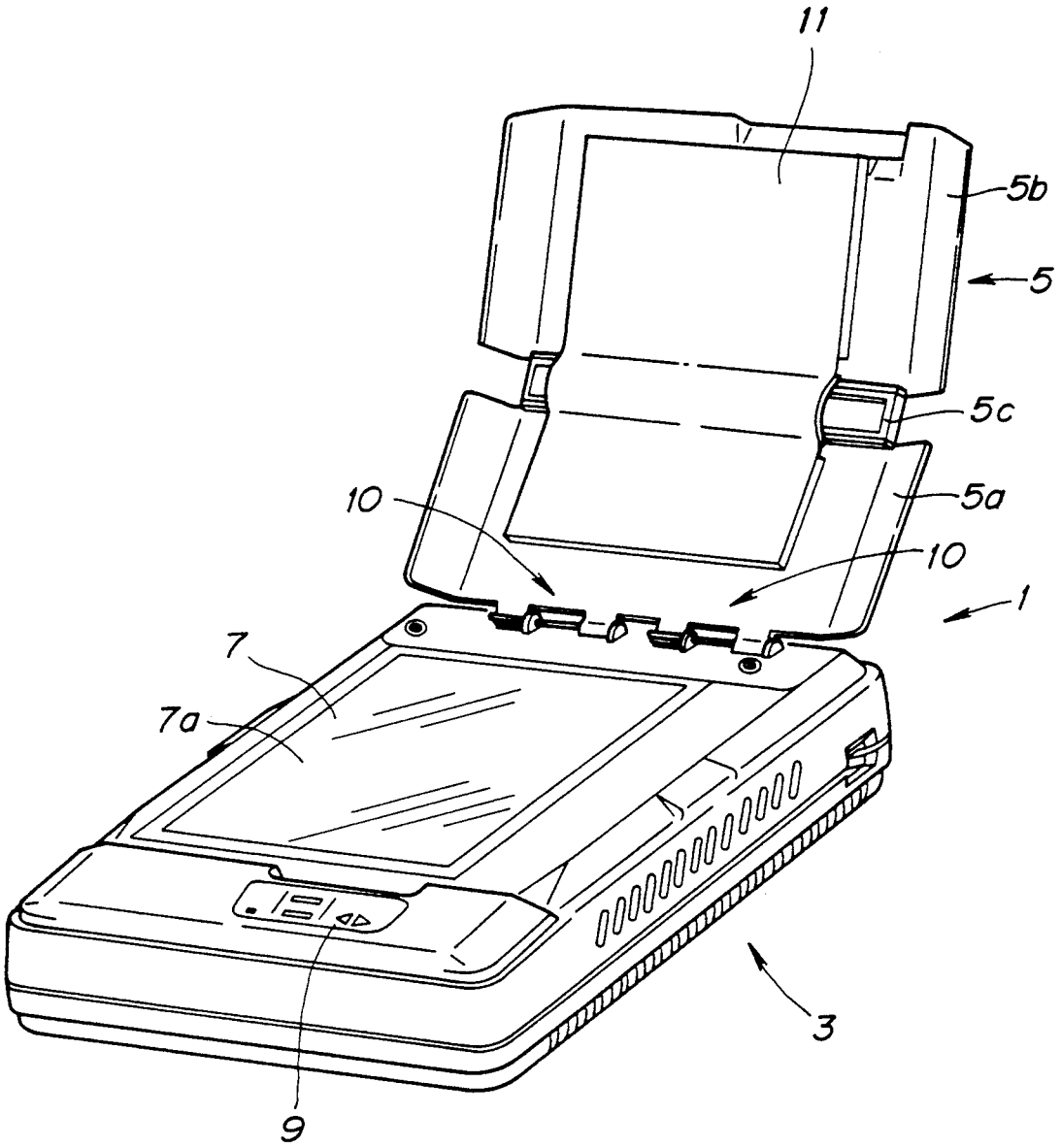
FIG. 1 is a perspective view of an image scanner which incorporates a hinge structure according to a first embodiment of the present invention.

FIG. 1 shows an image scanner 1 for reading image information from a copy and converting the image information into an electric signal. The image scanner 1 could be used to enter image information into a computer, for example. The image scanner 1 comprises a body 3 having on its upper surface a horizontal copy support plate 7 for placing a copy (not shown) to be read thereon, and a cover 5 swingably coupled to the body 3, for covering the copy support plate 7. The copy support plate 7 is in the form of an elongate rectangular transparent glass panel.

The body 3 houses a light source for applying light, from below the copy support plate 7, to a copy which is placed on the copy support plate 7 with an image side of the copy facing downwardly. The body 3 also houses an optical system for focusing light reflected from the image side of the copy onto an image focusing surface, and a photoelectric transducer, such as a CCD is positioned in the image focusing surface, for generating an electric signal representing the focused image. These components in the body 3 are known in the art, and hence are not shown and will not be described in detail. The body 3 has on its upper surface a control panel 9 disposed near one side of the copy support plate 7 and having keys for operating the image scanner 1 and indicator lamps.

The cover 5 serves as a light shield for preventing the light emitted by the light source from reaching the eyes of the user of the image scanner. It also serves as a copy holder for holding the copy, which is often a paper sheet, intimately down against the copy support plate 7 so that the image is well focused on the image focusing surface. In addition, the cover may be used to clamp the copy securely between the cover 5 and the copy support plate 7 prevent accidental displacement.

The cover 5 is in the form of an elongate plate or board and has a size large enough to cover an entire copy support surface area 7*a* of the copy support plate 7. The cover 5 comprises two relatively rigid synthetic resin panels 5*a*, 5*b* each being approximately equal to half the entire size of the cover 5, and a joint 5*c* by which the panels 5*a*, 5*b* are joined to each other for relative swinging movement through a certain angle. The joint 5*c* allows the cover 5 to be flexibly bent, so that the cover 5 can hold a thick copy, such as a book, down against the copy support plate 7. One side of the cove 5 is swingably joined to the body 3 through hinge units 10 (described later on) for angular movement between a closed position (horizontal lowered position, in which the cover 5 lies on the copy support plate 7, thus covering the copy support surface area 7*a*) and an open position (raised position, in which the side of the cover 5, opposite to the hinged side, is lifted to allow the user to access the copy on the copy support plate 7). A copy holder pad 11 for securely holding the copy against the copy support plate 7 is attached to one surface of the cover 5 (i.e., the lower surface when the cover 5 is in the closed position).

If the cover 5 is likely to interfere with the copy (e.g., if an image to be read is positioned in a portion of a large copy, and the entire size of the copy is about the same as or larger than the size of the upper sur face of the body 3 of the image scanner 1), it is desirable that the cover 5 be separated and removed from the body 3. The hinge structure according to the present invention is designed to separably couple the cover 5 to the body 3.

The hinge structure will now be described with reference to FIG. 2.

Figure 2:
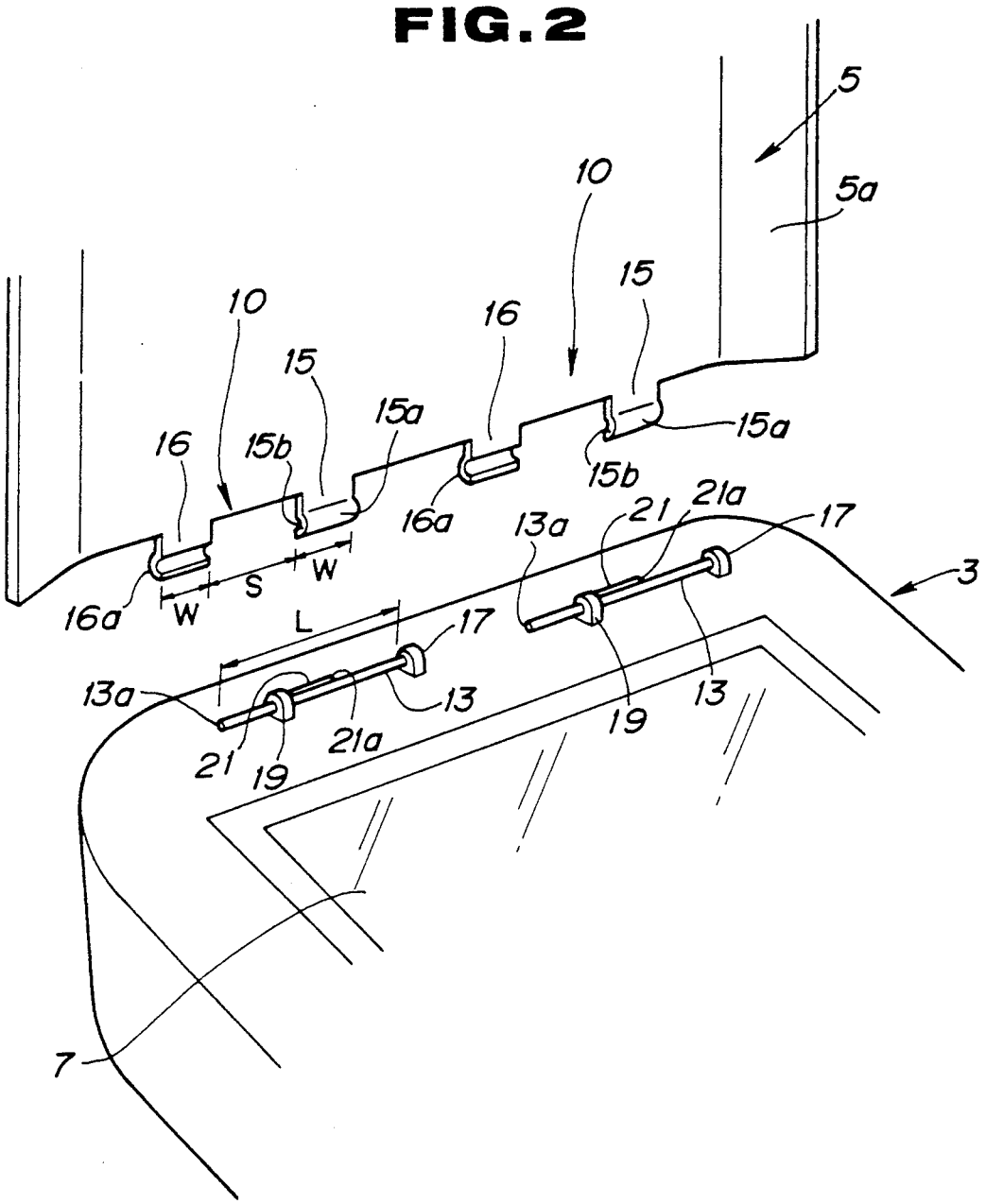
FIG. 2 is an enlarged fragmentary perspective view of the hinge structure shown in FIG. 1, the view showing hooks disengaged from rods of the hinge structure.

FIG. 2 shows at enlarged scale a hinge structure, according to a first embodiment of the present invention, for use on the image scanner 1. The hinge structure comprises two hinge units 10 which are aligned with each other. Each of the hinge units 10 comprises a rod 13, with circular cross section, fixed to one side of the upper surface of the body 3, and first and second engaging members or hooks 15, 16 fixed to the panel 5*a* of the cover 5 and engageable with the rod 13. The rods 13 of the hinge units 10 are held in line with each other, thereby holding the hinge units 10 in alignment with each other.

In each hinge unit 10, the rod 13 is supported by the first and second projections or trunnions 17, 19 mounted on the upper surface of the body 3, and slightly spaced upwardly from the upper surface of the body 3. The rod 13 has a length L, with one free end 13*a* projecting beyond the second trunnion 19. The first trunnion 17 supports one end of the rod 13, remote from the free end 13*a* thereof, and the second trunnion 19 supports an intermediate portion of the rod 13, which is about L/3 spaced from the free end 13*a*.

The hooks 15, 16 may be integrally formed with the panel 5*a* of the cover 5. Alternatively, the hooks 15, 16 may be fabricated separately from the panel 5*a*, and then subsequently fixed to the panel 5*a*. If the panel 5*a* is molded of synthetic resin or stamped from a metal sheet, then the hooks 15, 16 should preferably be integrally formed with the panel 5*a* for a reduction in the cost. The hooks 15, 16 project outwardly from an edge of the panel 5*a*, with their inner confronting edges spaced from each other by a distance S. The distance S is substantially equal to but slightly larger than ⅓ of the length L of the rod 13. Each of the hooks 15, 16 has a width W which is substantially equal to but slightly smaller than L/3. The hooks 15, 16 have on their distal ends respective semi-cylindrical bearings 15*a*, 16*a* slidably engaging the rod 13. When the semi-cylindrical bearings 15*a*, 16*a* engage the rod 13, they are positioned respectively on the diametrically opposite sides of the rod 13, and have respective inner semi-cylindrical surfaces facing away from each other. Therefore, the rod 13 is gripped between the semi-cylindrical bearings 15*a*, 16*a*. Since the semi-cylindrical bearings 15*a*, 16*a* are spaced from each other in the axial direction of the rod 13, at least two hinge units 10 are required for stable hinged connection between the cover 5 and the body 3.

When the hooks 15, 16 engage the rod 13, they themselves are allowed to slide in the longitudinal direction of the rod 13 and also turn about the axis of the rod 13. Actually, however, such sliding and turning movement of the hooks 15, 16 is only selectively permitted because of a movement limiting mechanism which will be described below.

Figure 3:
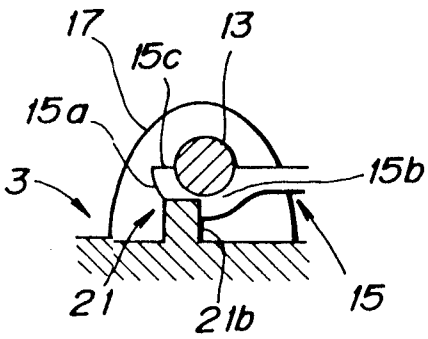
FIGS. 3(1) through 3(6) are enlarged views of hooks and rods, with stop ridges shown in FIGS. 3(1) through 3(3)
Figure 3:
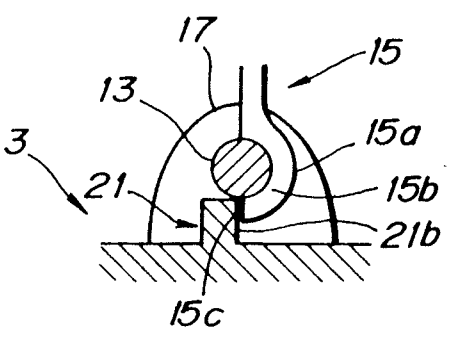
Figure 3:
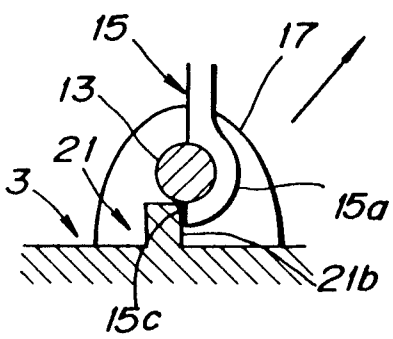
Figure 3:
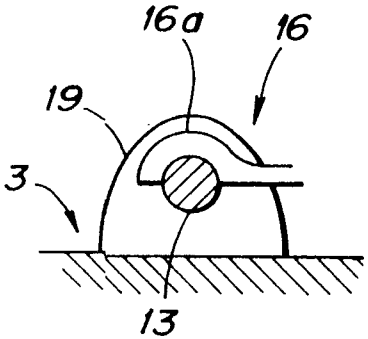
Figure 3:
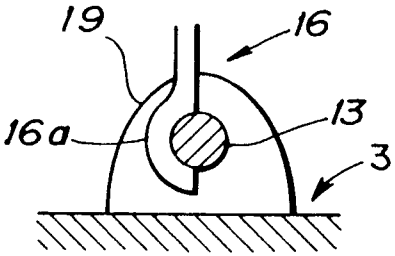
Figure 3:
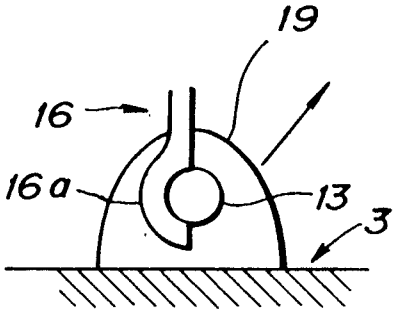

As shown in FIGS. 2 and 3(1) through 3(3), the movement limiting mechanism comprises a stop ridge 21 on the upper surface of the body 3. FIGS. 3(1) through 3(6) schematically show a rod and a hook shown in FIG. 2.

The stop ridge 21 is disposed near the rod 13 and extends parallel to the rod 13. The stop ridge 21 is positioned substantially beneath, but slightly displaced laterally from, the rod 13, and extends from the second trunnion 19 to a position intermediate between the first and second trunnions 17, 19. Therefore, the length of the stop ridge 21 is about ⅓ of the length L of the rod 13 (i.e., L/3), and is substantially equal to but slightly smaller than the width W of the first hook 15 of the cover 3. The stop ridge 21 has an end 21*a* closer to the first trunnion 17. The end 21*a* is being engageable with a side edge 15*b* of the semi-cylindrical bearing 15*a* of the first hook 15, which side edge 15*b* is closer to the second hook 16. The stop ridge 21 has a side 21*b* closer to the rod 13. The side 21*b* is engageable with an end edge 15*c* of the semi-cylindrical bearing 15*a* of the first hook 15.

The stop ridge 21 functions to stop sliding and turning movement of the hook 15, 16 with respect to the rod 13 of each of the hinge units 10, as described below.

While the image scanner 1 is in normal use, the cover 5 is swingably coupled to the body 3 by the hinge units 10. At this time, in each hinge unit 10, the first hook 15 is positioned on the rod 13 between the first trunnion 17 and the end 21*a* of the stop ridge 21, and the second hook 16 is positioned on the rod 13 between the free end 13*a* thereof and the second trunnion 19. The position in which the pair of hooks 15, 16 is now located in the longitudinal direction of the rod 13 will be referred to as a "first longitudinal position". When the pair of hooks 15, 16 is in the first longitudinal position on the rod 13;

1) the pair of hooks 15, 16 is allowed about the axis of the rod 13, and hence the cover 5 is allowed to swing relatively to the body 3 about the axis of the rod 13;

2) the pair of hooks 15, 16 is not separable from the rod 13 unless it is shifted into another longitudinal position along the rod 13, because the hooks 15, 16 grip the rod 13; and 3) the pair of hooks 15, 16 is prevented from moving in the longitudinal direction of the rod 13 if the pair of hooks 15, 16 is in a first relative angular range with respect to the rod 13, and the pair of hooks 15, 16 is allowed to move from the first trunnion 17 toward the second trunnion 19 in the longitudinal direction of the rod 13 if the pair of hooks 15, 16 is in a second relative angular range with respect to the rod 13.

More specifically, the first relative angular range for the pair of hooks 15, 16 is an angular range extending from an angular position in which the hooks 15, 16 lie substantially horizontally (see FIGS. 3(1) and 3(4); at this time the cover 5 is in the closed position, lying over the copy support plate 7) toward an angular position that immediately precedes the angular position in which the hooks 15, 16 are erected substantially vertically (see FIGS. 3(2) and 3(5); at this time the cover 5 is in the open position and raised). When the pair of hooks 15, 16 is in the first relative angular range, the side edge 15*b* of the bearing 15*a* of the first hook 15, being the side edge which is closer to the second hook 16, is held in engagement with the end 21*a* of the stop ridge 21, being the side which is closer to the first trunnion 17. Therefore, the pair of hooks 15, 16 is prevented from moving toward the second trunnion 19 in the longitudinal direction of the rod 13.

The second relative angular range for the pair of hooks 15, 16 includes the angular position shown in FIGS. 3(2) and 3(5). When the pair of hooks 15, 16 is in the second relative angular range, the side edge 15*b* of the first hook 15 and the end 21*a* of the stop ridge 21 disengage from each other, so that the pair of hooks 15, 16 is allowed to move in the longitudinal direction of the rod 13 from the first trunnion 17 toward the second trunnion 19.

When the cover 5 is raised as shown in FIG. 1, therefore, the cover 5 is movable in the longitudinal direction of the rod 13 from the first trunnion 17 toward the second trunnion 19 in each of the hinge units 10. If it is desired to separate the cover 5 from the body 3, the cover 5 is moved in the longitudinal direction of the rod 13, as described above, until the side edge 15*b* of the first hook 15 abuts against the second trunnion 19. Upon abutment of the side edge 15*b* against the second trunnion 19, the second hook 16 is disengaged from the rod 13 The position at this time along the longitudinal direction of the rod 13 will be referred to as a "second longitudinal direction". With the pair of hooks 15, 16 in the second longitudinal direction inasmuch as the second hook 16 is disengaged from the rod 13, the pair of hooks 15, 16 can be separated from the rod 13 when the cover 5 is lifted obliquely upwardly as indicated by the arrows in FIGS. 3(3) and 3(6). Accordingly, the cover 5 can be separated and removed from the body 3.

It can be understood that with the stop ridge 21, the pair of hooks 15, 16 can move along the rod 13 between the first and second longitudinal positions while being held in sliding engagement with the rod 13, insofar as the pair of hooks 15, 16 is in the second relative angular range. Therefore, the stop ridge 21 serves as a selective movement limiting means for selectively preventing the pair of hooks 15, 16 from moving along the rod 13 between the first and second longitudinal positions, depending on the angular position of the pair of hooks 15, 16 relative to the rod 13.

To couple the cover 5 to the body 3 again, the cover 5 is first positioned over the body 3 so that the pair of hooks 15, 16 is brought into the second longitudinal position on the rod 13, and then the cover 5, as it is erected, is moved in the longitudinal direction of the rod 13 until the pair of hooks 15, 16 reaches the first longitudinal position.

A hinge structure according to a second embodiment of the present invention will be described below with reference to FIGS. 4 and 5(1) through 5(3).

The hinge structure according to the second embodiment is incorporated in an image scanner identical to the image scanner 1 shown in FIG. 1. Those components of the image scanner shown in FIG. 4 which are identical to those shown in FIG. 1, except the hinge structure, are denoted by identical reference numerals and will not be further described in detail.

Figure 4:
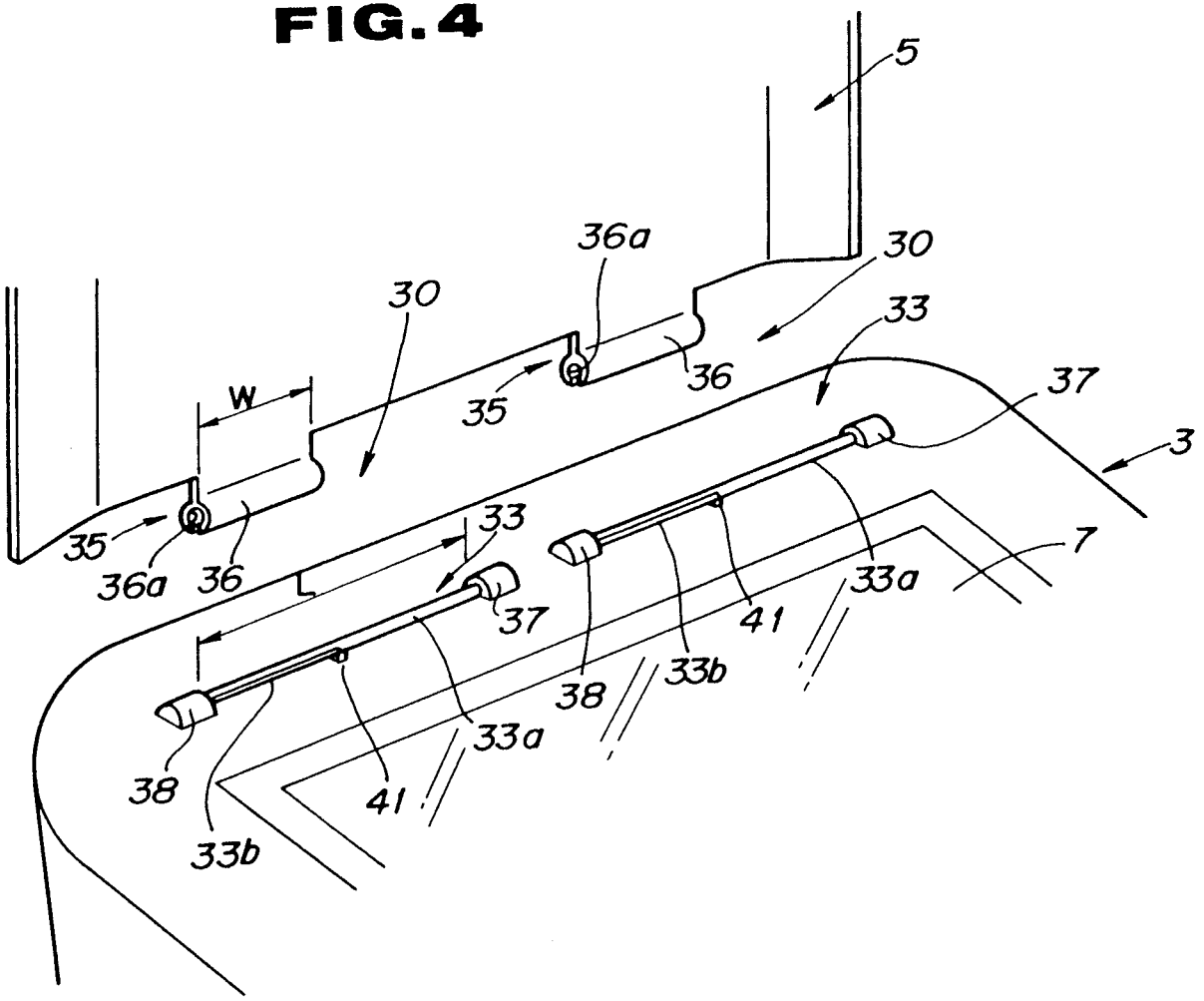
FIG. 4 is an enlarged fragmentary perspective view of a hinge structure according to a second embodiment of the present invention, with hooks shown as being disengaged from rods.

FIG. 4 shows the hinge structure according to the second embodiment at an enlarged scale. The hinge structure comprises two hinge units 30 which are aligned with each other. Each of the hinge units 30 comprises a rod 33 fixed to one side of the upper surface of the body 3 of the image scanner, and an engaging member or hook 35 fixed to the cover 5 and engageable with the rod 33. The rods 33 of the hinge units 30 are held in line with each other, thereby holding the hinge units 30 in alignment with each other.

In each hinge unit 30, the rod 33 is supported at opposite ends thereof by first and second projections or trunnions 37, 38 mounted on the upper surface of the body 3, and slightly spaced upwardly from the upper surface of the body 3. The rod 33 has a length L. The rod 33 includes a first half portion 33*a*, closer to the first trunnion 37 and of circular cross section having a diameter d (as shown in FIG. 5(1)), and a second half portion 33*b*, closer to the second trunnion 38 and having a cross section which is produced by cutting off diametrically opposite portions of a circular cross section of diameter d. (as shown in FIGS. 5(2) and 5(3)). Therefore, the second half portion 33*b* has a smaller width than the first half portion 33*a*.

The hook 35 projects outwardly from an edge of the cover 5, and has on its distal end a partly cylindrical bearing 36 slidably engaging the rod 33. The bearing 36 has a cylindrical hole 36*a* defined axially therein and having a diameter which is the same as the diameter of the rod 33, the cylindrical hole 36*a* serving to accommodate the rod 33 therein. The hook 35 has a width W which is the same as the length of the bearing 36. The width W is substantially equal to but slightly smaller than the length L/2 of each of the first and second half portions 33*a*, 33*b*. The partly cylindrical bearing 36 has an axial slot 36*b* defined therein and remotely from the cover 5 and communicating with the hole 36*a*. The slot 36*b* has a width substantially equal to but slightly larger than the width of the second half portion 33*b* of the rod 33, and smaller than the diameter d of the first half portion 33*a* of the rod 33 (see FIG. 5(2)). The bearing 36*a* can be mounted on and separated from the rod 33 at the second half portion 33*b* through the slot 36*b* (see FIGS. 5(2) and 5(3)). The bearing 36*a* is prevented from being separated from the rod 33 at the first half portion 33*a* (see FIG. 5(1)).

When the bearing 36 engages the rod 33, the bearing 36 itself is allowed to slide in the longitudinal direction of the rod 33 and also turn about the axis of the rod 33. Actually, however, such sliding and turning movement of the bearing 36 is only selectively permitted because of a movement limiting mechanism which will be described below.

As shown in FIGS. 4 and 5(1) through 5(3), the movement limiting mechanism comprises a stop tooth 41 on the upper surface of the body 3.

The stop tooth 41 is disposed directly below a middle point of the rod 33. (i.e., the boundary between the first and second half portions 33*a*, 33*b*). The stop tooth 41 extends upwardly to a position immediately beneath the lower surface of the rod 33. The stop tooth 41 has a width (in a horizontal direction normal to the rod 33) substantially equal to but sightly smaller than the width of the slot 36*b* in the bearing 36, as better shown in FIG. 5(2). When the bearing 36 is positioned on the first half portion 33*a* of the rod 33, the stop tooth 41 engages the end of the bearing 36 closer to the second trunnion 38, unless the slot 36*b* is aligned with the stop tooth 41, in which case, the stop tooth 41 prevents the bearing 36 from moving toward the second trunnion 38 along the rod 33. At this time, the bearing 36 is angularly movable about the axis of the rod 33, and hence the cover 5 is swingable with respect to the body 3. When the slot 36*b* is axially aligned with the stop tooth 41. (i.e., when the slot 36*b* is positioned beneath the rod 33 and (the cover 5 is erect), the bearing 36 and hence the cover 5 are allowed to move in the longitudinal direction of the rod 33.

When the bearing 36 is positioned between the first trunnion 37 and the stop tooth 41 in the longitudinal direction of the rod 33, the bearing 36 is in a first longitudinal position. When the bearing 36 is positioned along the rod 33 with one end contacting the second trunnion 38, the bearing 36 is in a second longitudinal position. When the slit 36*b* is axially aligned with the stop tooth 41, the bearing 36 is in a second relative angular range, which is actually an angular position or a small angular range, with respect to the rod 33. The other relative angular range than the second relative angular range, in which the bearing 36 may be with respect to the rod 33, is referred to as a first relative angular range.

It will be understood that the first longitudinal position, the second longitudinal position, the first relative angular range, and the second relative angular range in the second embodiment bear a clear analogy to those in the first embodiment. More specifically:

1) when the bearing 36 is in the first longitudinal position, it is allowed to swing about the axis of the rod 33, and hence the cover 5 is allowed to swing relatively to the body 3 about the axis of the rod 33, 2) when the bearing 36 is in the first longitudinal position, it is not separable from the rod 33, and when the bearing 36 is in the second longitudinal position, it is separable from the rod 33; and 3) when the bearing 36 is in the first relative angular range with respect to the rod 33, the bearing 36 is prevented from moving between the first and second longitudinal positions, and when the bearing 36 is in the second relative angular range or position with respect to the rod 33, the bearing 36 is allowed to move between the first and second longitudinal positions.

It can be understood that, as with the stop ridge 21 according to the first embodiment, the stop tooth 41 serves as a selective movement limiting mechanism for selectively preventing the bearing 36 from moving along the rod 33 between the first and second longitudinal positions, depending on the angular position of the bearing 36 relative to the rod 33.

To couple the cover 5 to the body 3, the cover 5 as it is erected is first positioned over the body 3 so that the bearing 3 of the hook 35 is disposed on the second half portion 33*b* of the rod 33 (i.e., in the second longitudinal position). Then the cover 5, as it is erected, is moved in the longitudinal direction of the rod 33 until the bearing 33 is displaced onto the first half portion 33*a* of the rod 33 (i.e., into the first longitudinal position). Now, the cover 5 is swingably joined to the body 3. The cover 5 may be removed from the body 3 by reversing the above process.

In the above embodiments, the stop ridge and the stop tooth, functioning as the selective movement limiting mechanism, are formed on the upper surface of the body 3. Alternatively, the stop ridge and the stop tooth may be formed respectively on the rods 13, 33. The first and second relative angular ranges may have desirably selected magnitudes.

Although certain preferred embodiments have been shown and described, it should be understood that many changes and modifications may be made therein without departing from the scope of the appended claims.

I claim:

1. A hinge structure for coupling a first member, to be swingable and separable relative to a second member, comprising:

a) at least one rod adapted to be fixed to said second member;

b) engaging means for disengageably engaging said rod, said engaging means being adapted to be fixed to said first member;

c) said engaging means being movable between first and second longitudinal positions in a longitudinal direction of said rod while said engaging means is engaging said rod, whereby said first member is movable relative to said second member in the longitudinal direction of said rod;

d) said engaging means being angularly movable about the axis of said rod in at least said first longitudinal position, thereby allowing said first member to swing relative to said second member about the axis of said rod;

e) said engaging means being inseparable from said rod when said engaging means is in said first longitudinal position, and separable from said rod when said engaging means is in said second longitudinal position;

f) said engaging means comprising at least a pair of hooks aligned with each other and having respective semi-cylindrical bearings disengageably said rod, said semi-cylindrical bearings being positioned respectively on opposite sides of said rod while said engaging means is engaging said rod and comprising inner semi-cylindrical surfaces facing away from each other, said hooks each having a width W that is substantially equal to but less than L/3, in which L is the length of said rod, and said hooks in each pair being spaced from one another by a distance S that is substantially equal to but slightly larger than L/3;

g) selective movement limiting means for selectively preventing said engaging means from moving between said first and second longitudinal positions; and h) said selective movement limiting means comprising means for preventing said engaging means from moving between said first and second longitudinal positions when said engaging means is in a range of first relative angular positions with respect to said rod, and for allowing said engaging means to move between said first and second longitudinal positions when said engaging means is in a range of second relative angular positions with respect to said rod.

2. A hinge structure according to claim 1, wherein said selective movement limiting means comprises a ridge adapted to be disposed on said second member, for coacting with one of said hooks in engagement therewith, said ridge being disposed near said rod and extending parallel to said rod along a portion of the entire length of said rod.

3. A hinge structure according to claim 1, wherein said second member comprises a body of an image scanner, said body having a copy support plate on an upper surface of said body, and said first member comprises a cover of the image scanner, for covering said copy support plate.

4. A hinge structure according to claim 1, wherein the hinge structure comprises two said rods and two pairs of said hooks, said pairs of hooks being disengageably engageable, respectively, with said rods for coupling said first member to said second member.

5. A hinge structure for coupling a first member, to be swingable and separable relative to a second member, comprising:

a) two rods aligned with each other, each of said rods being supported by a pair of trunnions that are adapted to be fixed to said second member;

b) engaging means for disengageably engaging each of said rods, said engaging means being adapted to be fixed to said first member;

c) said engaging means being movable between first and second longitudinal positions in a longitudinal direction of said rods while said engaging means is engaging said rods, whereby said first member is movable relative to said second member in the longitudinal direction of said rods;

d) said engaging means being angularly movable about an axis of said rods in at least said first longitudinal position, thereby allowing said first member to swing relative to said second member about the axis of said rods;

e) said engaging means being inseparable from said rods when said engaging means is in said first longitudinal position, and separable from said rods when said engaging means is in said second longitudinal position;

f) said engaging means comprising two pairs of hooks aligned with each other and having respective semi-cylindrical bearings disengageably engaging said rods, said semi-cylindrical bearings being positioned respectively on opposite sides of said rods while said engaging means is engaging said rods;

g) selective movement limiting means for selectively preventing said engaging means from moving between said first and second longitudinal positions; and h) said selective movement limiting means comprising means for preventing said engaging means from moving between said first and second longitudinal positions when said engaging means is in a range of first relative angular positions with respect to said rods, and for allowing said engaging means to move between said first and second longitudinal positions when said engaging means is in a range of second relative angular positions with respect to said rods.

6. A hinge structure according to claim 5, wherein said semi-cylindrical bearings comprise inner semi-cylindrical surfaces facing away from each other, said hooks each having a width W that is substantially equal to but less than L/3, in which L is the length of one of said rods.

7. A hinge structure according to claim 5, wherein said hooks in each pair are spaced from one another by a distance S that is substantially equal to but slightly larger than L/3, in which L is the length of one of said rods.

8. A hinge structure for swingably and detachably coupling a first member to a second member, comprising;

at least one rod adapted to be fixed to said second member;

engaging means, fixed to said first member, for disengageably engaging said rod;

said engaging means being movable between first and second longitudinal positions in a longitudinal direction of said rod while said engaging means is engaged with said rod, whereby said engaging means is angularly movable about the axis of said rod in at least said first longitudinal position, said engaging means being insertable from said rod when in said first longitudinal position, and being separable from said rod when in said second longitudinal position; and said engaging means comprising at least a pair of hooks aligned with each other and having respective semi-cylindrical bearings disengageably engaging said rod, said semi-cylindrical bearings positioned respectively on opposite sides of said rod while said engaging means is engaged with said rod, said hooks in each pair being spaced from one another by a distance that is substantially equal to but slightly larger than one-third the length of said rod.

9. A hinge structure according to claim 8, further comprising selective movement limiting means for selectively preventing said engaging means from moving between said first and second longitudinal position.

10. A hinge structure according to claim 9, wherein said selective movement limiting means comprises means for preventing said engaging means from moving between said first and second longitudinal positions when said engaging means is in a range of first relative angular positions with respect to said rod, and for allowing said engaging means to move between said first and second longitudinal positions when said engaging means is in a range of second relative angular positions with respect to said rod.

11. A hinge structure according to claim 8, wherein the hinge structure comprises two said rods and two pairs of said hooks, said pairs of hooks being disengageably engageable, respectively, with said rods for coupling said first member to said second member.

12. A hinge structure according to claim 8, wherein each of said hooks has a width that is substantially equal to but less than one-third the length of said rod.

* * * * *

UNITED STATES PATENT AND TRADEMARK OFFICE

CERTIFICATE OF CORRECTION

PATENT NO. : 5,265,310

DATED : November 30, 1993

INVENTOR(S) : Kazuhiro ICHINOKAWA

It is certified that error appears in the above-indentified patent and that said Letters Patent is hereby corrected as shown below:

At column 9, line 51 (claim 1, line 27) after "disengageably" insert ---engaging---.

At column 11, line 27 (claim 8, line 14) change "insertable" to ---inseparable---.

Signed and Sealed this

Fifth Day of September, 1995

*Attest:*

*Attesting Officer*

BRUCE LEHMAN

*Commissioner of Patents and Trademarks*